United States Patent [19]

Späth

[11] Patent Number: 4,847,930

[45] Date of Patent: Jul. 18, 1989

[54] RAISING DEVICE FOR ATTACHMENT TO HOSPITAL BEDS

[76] Inventor: Walter Späth, Bordwaldstrasse 74,, Radolfzell, Fed. Rep. of Germany, 7760

[21] Appl. No.: 929,791

[22] Filed: Nov. 13, 1986

[30] Foreign Application Priority Data

Nov. 13, 1985 [DE] Fed. Rep. of Germany ..... 3540302

[51] Int. Cl.[4] ..... A61G 7/10

[52] U.S. Cl. ..... 5/84; 5/445

[58] Field of Search ..... 5/83, 84, 87, 445; 188/70 R, 343, 82.9; 175/423; 248/412, 406.1, 406.2; 285/141

[56] References Cited

U.S. PATENT DOCUMENTS

| | | | |
|---|---|---|---|
| 1,849,102 | 3/1932 | Livergood | 175/423 |
| 2,010,284 | 8/1935 | Wickersham | 285/141 |
| 3,228,647 | 1/1966 | Musianowycz | 248/412 |
| 3,765,053 | 10/1973 | Anweiler | 16/86 C |
| 3,776,387 | 12/1973 | Brent | 248/412 |
| 3,822,768 | 7/1974 | Sebulke | 188/70 R |
| 4,113,222 | 9/1978 | Frinzel | 248/412 |
| 4,445,660 | 5/1984 | Karapita | 248/412 |
| 4,463,481 | 8/1984 | Rastetter et al. | 175/423 |

FOREIGN PATENT DOCUMENTS

| | | | |
|---|---|---|---|
| 273047 | 6/1964 | Australia | 248/412 |
| 2458838 | 6/1976 | Fed. Rep. of Germany | 248/412 |
| 3327320 | 2/1985 | Fed. Rep. of Germany | 5/84 |
| 1138172 | 12/1968 | United Kingdom | 248/412 |

*Primary Examiner*—Alexander Grosz
*Assistant Examiner*—Eric K. Nicholson
*Attorney, Agent, or Firm*—Fleit, Jacobson, Cohn, Price, Holman & Stern

[57] ABSTRACT

A raising device for attachment to hospital beds consists of an oval tube mounted in a support and which can be rotated and locked in any desired position of rotation, on whose upper free end a handgrip is arranged by which the patient can pull himself up. He can swing himself to the edge of the bed by rotation of the oval tube, and as soon as the oval tube is pre-loaded in an axial direction a clutch engages which is built in to a support arranged on the bed-head. The clutch consists of a clutch member connected as an axial extension of the oval tube which has an axial shoulder formed as a cone which engages in a corresponding conical recess of a radially expandable brake shoe whose outer circumference can be pressed in a free-locking fashion against the inner side of a bearing cup which is a bearing for the clutch. Such a clutch enables the rotational position of the oval tube to be locked in any desired angular position.

6 Claims, 4 Drawing Sheets

RAISING DEVICE FOR ATTACHMENT TO HOSPITAL BEDS

BACKGROUND OF THE INVENTION

The invention concerns a raising device for attachment to hospital beds. A lifting device of this type is known for example from the disclosure of DE-OS No. 33 27 320.

Such raising devices are used particularly for patients who have just undergone operations or who are handicapped. In such a device the bedridden patient gets hold of a triangular grip and pulls himself up by it. An oval tube is in this case mounted to be pivotable in the support so that the patient can, by hanging on to the hand grip, swing himself to the edge of the bed by the rotation of the oval tube in the support. An anti-rotation clutch is provided to ensure the retention of the pivotable oval tube in any desired position of rotation in the support. By means of this, the oval tube is prevented from swinging too far and, for example, damaging objects near the bed.

In the case of the known raising device, the clutch consists of a dog clutch which can be engaged against the spring loading of a coil spring. A disadvantage of such an arrangement is that a locking of this clutch in desired intermediate positions is not possible, as because of the teeth positions of the engaging dog clutch, only specific angles of rotation can be locked.

A further disadvantage of this known raising device is that the clutch has a high rate of wear because the long leverage from the holding grip to the axis of rotation of the oval tube cause high torque loads to be transmitted to the clutch which leads to rapid wear of the dogs (teeth).

BRIEF SUMMARY OF THE INVENTION

The invention solves the technical problem of further developing a raising device of the type mentioned in the introduction so that a locking in the desired positions of rotation is possible and premature wear of the clutch is avoided.

To solve this problem the invention is characterized in that the clutch consists of a clutch part connected as an axial extension of the oval tube and secured to it so that it cannot turn. The clutch part has an axial shoulder formed as a cone which engages in a corresponding conical recess of a radially-expandable brake shoe whose outer circumference can be pressed in a force-locking fashion against the inner side of a bearing cup which is a bearing for the clutch.

A feature of the invention is therefore that the oval tube is secured against rotation to an axial shoulder formed as a cone and which engages in a corresponding conical recess of a radially-expandable brake shoe. Because of the mutual engagement of the wedge faces of the cone and the corresponding wedge faces in the area of the conical recess, high torque loads are absorbed in a relatively wear-free manner and locking in any desired position of rotation is possible.

It is essential here, in accordance with the subject matter of claim 2, that the brake shoes consist of several segment-shaped parts which are separated from each other by radial slots. On the outer circumference of the brake shoes is an annular groove in which a tension spring is arranged which enclosed all the parts.

When the axial shoulder, which is formed as a cone and which is secured against turning to the oval tube, is pushed in an axial direction into the conical recess of the brake shoes, the segmentshaped parts of the brake shoes are pressed radially outwards against the force of the tension spring enclosing all parts. These segment-shaped parts then come to rest with their outer circumference against the inner side of a lower bearing cup whose inner side is axially fluted to act as a friction-increasing outer surface for the outer faces of the brake shoes pressed against it.

It is preferred if the clutch part secured to the oval tube against turning is made from metal and the corresponding brake shoes are of polyamide-plastic. In this way a great freedom from wear is ensured, and duration tests have shown that the mentioned material distinguishes itself by a particularly long operational life.

Further features of the invention are the subjects of the remaining sub-claims.

The subject of the present invention arises not only from the subject of the individual patent claims but also from the combination of the individual claims one with another. All details and features disclosed in the documents, particularly the three-dimensional layout illustrated in the drawings, are claimed as being essential to the invention in so far as they, either individually or in combination, are new as compared with the state of the art.

In the following the invention will be further explained by means or drawings illustrating merely one embodiment. Further features and advantages essential to the invention arise from the drawings and their descriptions.

DETAILED DESCRIPTION

Figure 1:
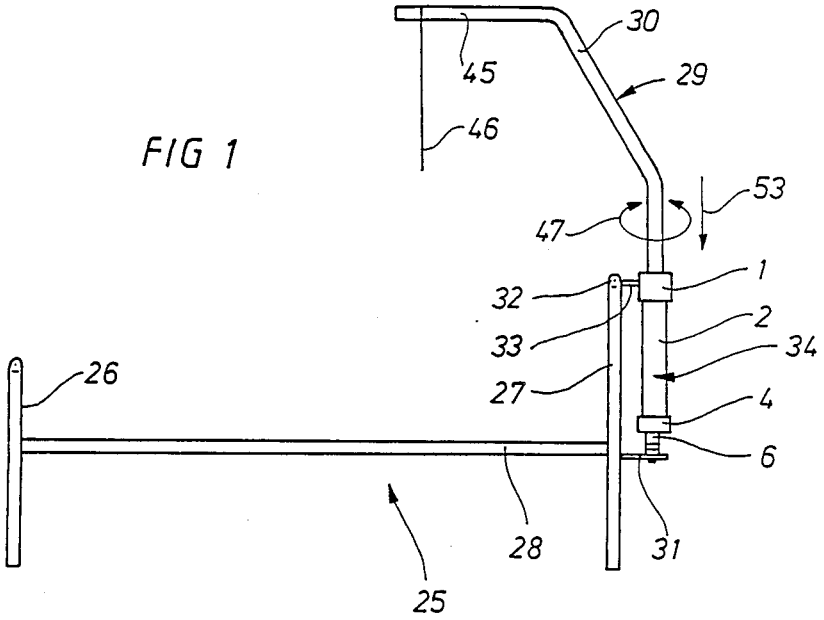
FIG. 1 is a schematic view of a hospital bed with a device in accordance with the invention.

The hospital bed (25) shown in FIG. 1 consists of, in the normal fashion, a bed frame (28) in whose front and rear end respectively a foot board (26) and a head board (27) are arranged. On the head board (27) a transverse spar (32) is fitted onto which an upper suspension fixture (33) for a support (34) is provided. At a distance from it, in the lower part of the head board (27) a guide plate (31) is provided into which the support (34) engages with a lower axial guide tube (6) (Refer to FIG. 2).

In the support (34) an oval tube (30) is mounted which is pivotable in arrow direction (47) and which is lockable, on whose horizontal part (45) a triangular handgrip (46) is arranged.

The complete raising device (29) consists therefore, of the handgrip (46), the oval tube (30) and the corresponding support (34).

Figure 2:
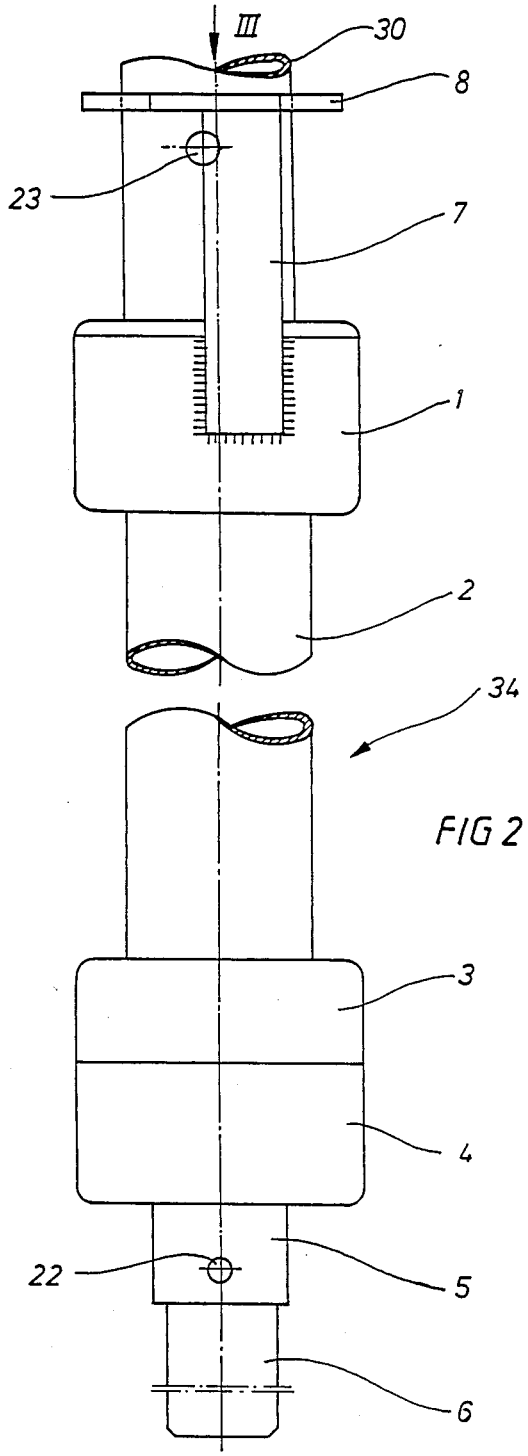
FIG. 2 is a side view of the support for the oval tube.

The support (34) is, in accordance with FIG. 2, connected to the head board (27) of the hospital bed (25) in quick-release fashion in that on the upper side of the support (34) a rotation safety (8) is arranged which consists of an enclosing ring in the underside of which aligned pins (23), directed inwards, are arranged. These pins are suspended in the suspension fixture (33) whereby, at the same time, the guide tube (6) engages in a corresponding recess in the lower carrier plate (31). In this way the support (34) is arranged in quick release fashion on the head board (27) and it requires no modification of currently-available hospital beds as the described supports (33)(34) are already available on current hospital beds.

From the rotation safety (8) downwards extends a retaining clip (7) which is welded onto the outside of the upper bearing cup (1); this carries the complete arrangement and secures against rotation.

On the underside of the bearing cup (1) a distance tube (2) abuts, which is connected at its opposite end to the lower bearing cup (4). The lower bearing cup (4) is closed with a cover (3) and it continues downwards as an axial bearing shaft seat (5) which ends in a guide tube (6) which, in the previously described fashion, is releasably inserted into the guide plate (31) on the head board (27) of the hospital bed (25).

Figure 3:
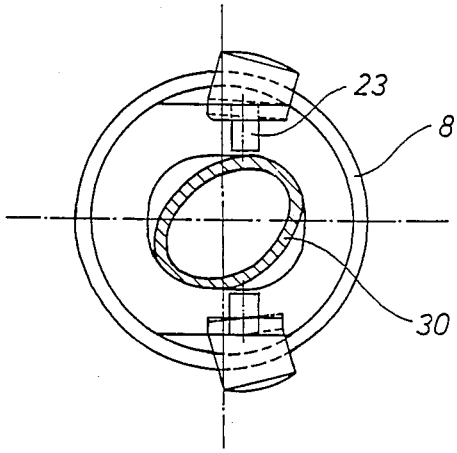
FIG. 3 is a front view of the support in the direction of arrow III in FIG. 2.

FIG. 3 shows that the oval tube (30) is inserted into a corresponding rectangular recess in form-locking fashion in which the outer circumference of the oval tube fits into the diagonal rounded recesses in the upper bearing cup (1).

Figure 4:
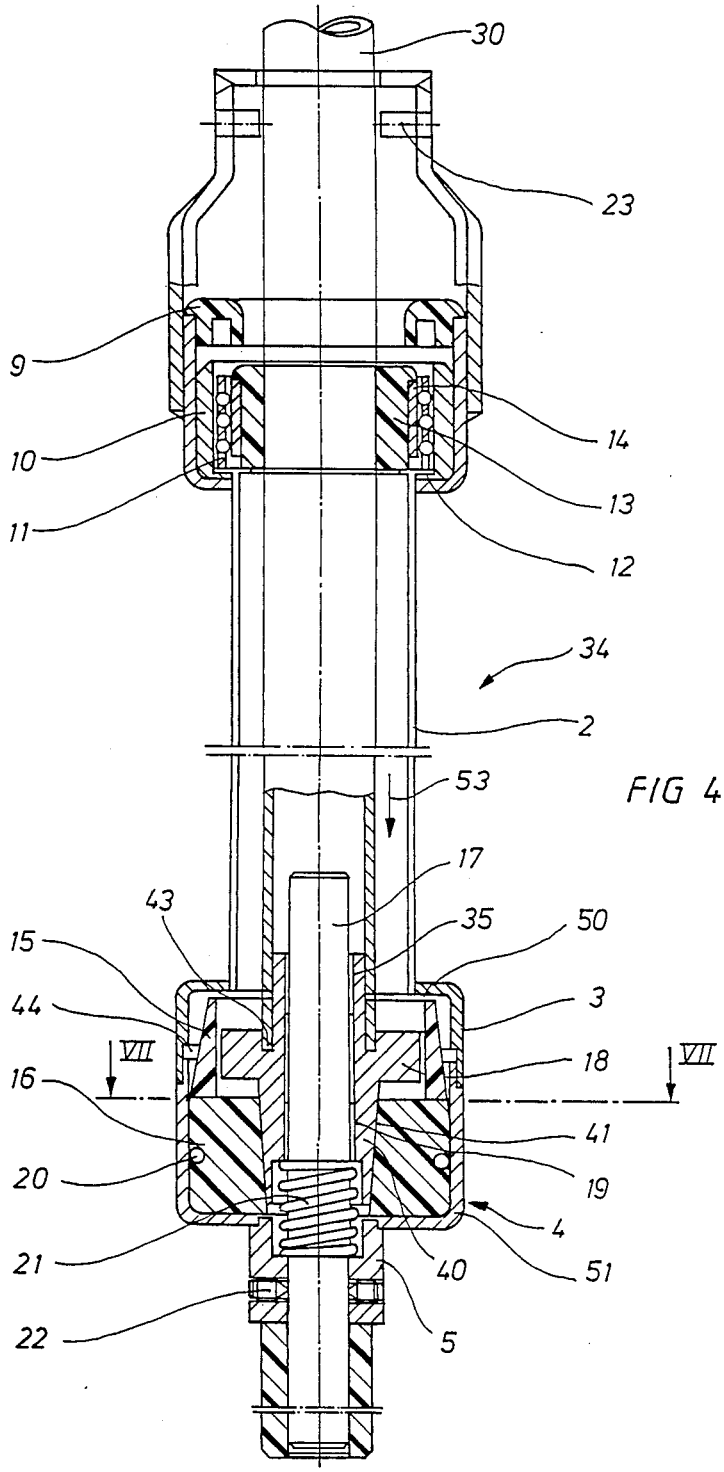
FIG. 4 is a longitudinal section through the support in accordance with FIG. 2.
Figure 5:
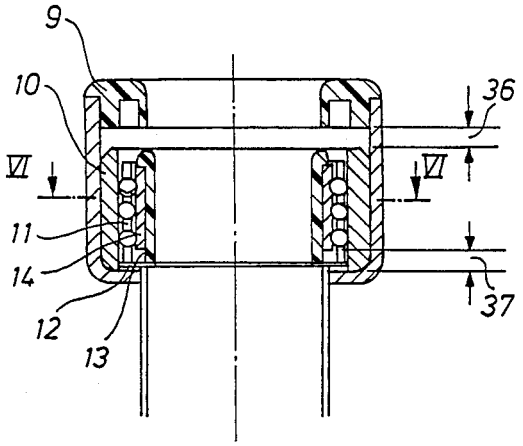
FIG. 5 is a section through the upper bearing cup.
Figure 6:
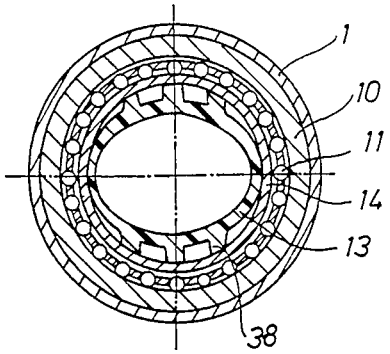
FIG. 6 is a section on the line VI—VI in FIG. 5.

The upper bearing cup consists, in accordance with FIGS. 4, 5 and 6, of an upper protective cover (9) which is placed on the beaker-shaped lower part of this bearing cup (1). In the lower part of this bearing cup (1) an outer bearing ring (10), which carries on its inner side a ball box (11) with balls arranged in it, which, on their inner side roll on an inner bearing ring (14). The inner bearing ring (14) is, again, supported in an inner oval guide bush (13) and the complete arrangement is mounted on a plastic ring (12) on the floor of the beaker-shaped lower part of the bearing cup (1).

In accordance with FIG. 6 the oval tube (30) while secure against rotation, is however mounted to be axially slidable in the oval bearing (13) and which bears against the corresponding inner face of the inner bearing ring (14) with ribs (38). The oval guide tube rotates and moves freely with the bearing bush both radially and axially.

By means of the described arrangement high tilt loads can be carried which, when a corresponding weight of the patient is brought to bear on the handgrip (46), are exerted on the upper bearing cup.

The complete bearing arrangement has built-in axial play in the upper bearing cup (1). For this reason the lower face of the protective cover (9) has an axial clearance to the upper face of the corresponding bearing arrangement which consists of the bearing ring (10), the ball box (11), the inner bearing ring (14) and the oval guide bush (13).

Likewise, the ball box (11) is slidable between the upper front face of the bearing ring (10) and its lower front face within the axial clearance.

Figure 7:
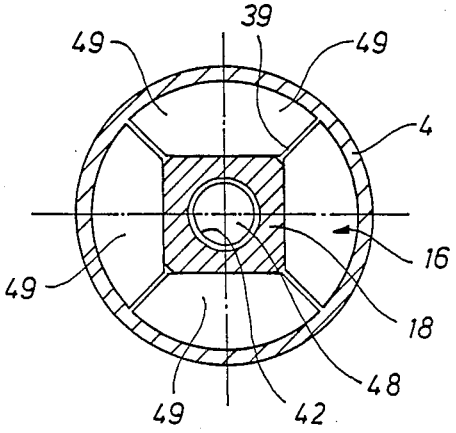
FIG. 7 is a section through the lower bearing cup on the line VII—VII in FIG. 4.
Figure 8:
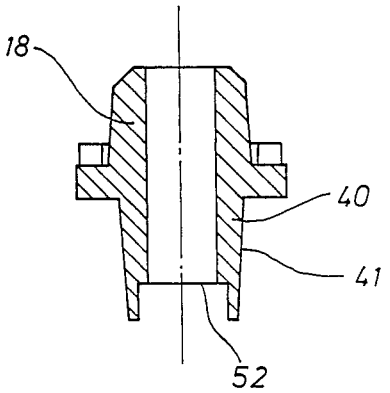
FIG. 8 is a section through the clutch part secured to the oval tube.

In accordance with FIGS. 4, 7, and 8 the inventive clutch is arranged in the lower bearing cup (4).

The lower bearing cup (4) consists of a cup of beaker-shaped lower part (51) whose upper end is closed off by a threaded cover (3).

Between the beaker-shaped lower part of the upper bearing cup (1) and the cover (3) a distance tube (2) is located.

The oval tube (30) which extends through the distance tube with axial and radial clearance, is connected on its underside, secured against rotation, with a clutch part (18) of metal e.g. cast iron, cast steel or similar, in which the lower face of the oval tube engages in an annular slot (43) in the clutch part (18).

This annular slot is not shown in FIG. 8 for reasons of simplification as it is likewise possible to press the oval tube onto the upper conically formed axial shoulder of the clutch part (18).

The clutch part (18) has a lower axial shoulder formed as a cone (40) which has outer wedge faces (41) which with the corresponding wedge faces (42) form a conical recess (48) of a brake shoe (16).

The brake shoes (16) in accordance with FIGS. 4 and 7 consist of a cylindrical part which is inserted in the lower part (51) of the lower bearing cup (4).

In the embodiment example the brake shoe (16) consists of four segment-shaped parts (49) separated by radial slots which are provided with an annular groove in which a tension spring (20) is fitted. The tension spring (20) holds the parts (49) together and tensions them radially inwards. All parts together form a conical recess (48) on whose inner side the previously mentioned wedge faces (42) are arranged, which act together with the corresponding wedge faces (41) of the clutch part (18).

As soon as the oval tube (30) is now moved in an axial direction in arrow direction (53) (refer to FIG. 1) downwards, the lower clutch part (18) moves, against the load of a coil spring (21), with its wedge faces (41) in the recess (48) of the brake shoe (16).

The coil spring then engages in a recess (52) in the clutch part (18) and is seated at its lower end in a bearing shaft seat, which at the same time serves as the support of a bearing shaft (17), on which the coil spring (21) is mounted to be both rotatable and axially slidable. The bearing shaft (17) is secured against turning in the bearing shaft seat (5) by a threaded pin (22) and engages mainly in the guide tube (6).

The upper side of the bearing shaft (17) is rotatably mounted in two separated journal bearing bushes (19)(35) in the clutch part (18).

With axial movement of the oval tube (30) in the direction of arrow (53) the wedge faces (41)(42) of the clutch part (18) and recess (48) slide together and the segment-shaped parts (49) of the brake shoe (16) are moved outwards against the load of the spring (20) and meet on the ribbed inner face of the lower part (51) of the lower bearing cup (4).

In this way high swivel loads can now be locked as, by means of the large surface area contact of the corresponding wedge faces (41)(42) on one side and by the large surface area contact of the outer circumference of the segment-shaped parts (49) on the ribbed inner face of the lower part (51), a force-locking loading of the parts named arises in the lower part (51).

It is essential here that the wedge faces (41)(42) are so inclined that they cannot clamp by themselves. That is, under the load of the coil spring (21) the described clutch is automatically disengageable by which the oval tube (30) is pushed upwards in the opposite direction to arrow (53) and the segment-shaped parts (49) of the brake shoe (16) are moved radially inwards again by the tension spring (20).

In order to avoid the brake shoes (16) being taken upwards in the opposite direction to the arrow direction (53) during disengagement of the clutch, a scraper (15) is provided which, as a ring, sits on the brake shoe (16) and forms a clearance (50) between its upper side and the underside of the lid (3).

Thus the brake shoe (16) can only move over the distance (50) in an axial direction in the lower bearing cup (4).

The lower bearing cup is simple to open because the cover (3) is screwed onto the lower part (51) by means of a corresponding thread (44) and is fixed, i.e. secured against turning, by glue.

The present invention is not limited to the use of an oval tube; it can also be realised using a round tube, as long as the corresponding mountings have round-profiled fittings. Other profiles such as rectangular or square are likewise possible. The arrangement can be directly used on present bed gantries and can be attached to the bed without alteration of the present fixtures.

What I claim is:

1. A raising device for attachment to hospital beds with a vertical support releasably connected to a headboard at a distance from said headboard, comprising:

a slidable oval tube inserted in said vertical support.

a coil spring exerting a load on said oval tube, said oval tube being rotatable and lockable against said load, a hand grip for a patient arranged on an upper free end of said oval tube, a clutch securing said oval tube against rotation arranged in said vertical support, said clutch, in case of axial movement of the oval tube, securing said oval tube against rotation and connecting said oval tube with the support, the clutch including a clutch part formed as an axial extension of the oval tube secured against rotation to the oval tube, a lower bearing cup, formed on said vertical support, in which said clutch is mounted, said lower bearing cup including a cup-shaped lower part, a radially expandable brake shoe arranged in said cup-shaped lower part, a tapered axial shoulder of said clutch part which engages in a corresponding tapered recess of said radially expandable brake shoe which can be pressed in a force-locking fashion into position on an inner side of said bearing cup and further comprising an upper cup-shaped cover by which the cup-shaped lower part is closed off and a ring-shaped scraper on an upper face of the brake shoe which has a clearance between its upper edge and an underside of the cover.

2. A raising device in accordance with claim 1, and further comprising several segment shaped parts, separated by radial slots, forming the brake shoe, and a second coil spring which encloses all of said segment shaped parts arranged in an annular groove provided in exterior surfaces of said segment shaped parts.

3. A raising device in accordance with claim 1, and further comprising a bearing shaft and a fixed bearing shaft seat on said bearing shaft, wherein one side of the coil spring abuts with a front face of said clutch part, and an opposite side of said coil spring abuts said fixed bearing shaft seat, the clutch part being axially slidable on said bearing shaft, which is connected as an axial extension of the oval tube.

4. A raising device in accordance with claim 2, wherein wedge faces in the area of the tapered recess of the brake shoe and wedge faces of the tapered axial shoulder of the clutch part are smoothly polished, the brake shoe consisting essentially of a polyamide plastic.

5. A raising device in accordance with claim 1 and further comprising an upper bearing cup, the vertical support being formed from the lower bearing cup and the upper bearing cup, a ring-shaped oval guide bush seated at a minimal clearance on an outer circumference of the oval tube an inner bearing ring against which a cylindrical outer surface of said guide bush abuts, a ball box, carried by said inner bearing ring, and an outer bearing ring which is securely connected to the upper bearing cup, said ball box arranged to be rotatably and axially slidable on an inner face of said outer bearing ring.

6. A raising device in accordance with claim 5, and further comprising a cover closing off a top of the upper bearing cup and forming a clearance between its lower face and an upper face of the ball box.

* * * * *